US011247500B2

(12) United States Patent
Wilflingseder et al.

(10) Patent No.: US 11,247,500 B2
(45) Date of Patent: Feb. 15, 2022

(54) TURNING DEVICE

(71) Applicant: COLOP STEMPELERZEUGUNG SKOPEK GESELLSCHAFT M.B.H. & CO. KG., Wels (AT)

(72) Inventors: Johann Wilflingseder, Dorf an der Pram (AT); Norbert Riedl, Geboltskirchen (AT)

(73) Assignee: COLOP STEMPELERZEUGUNG SKOPEK GESELLSCHAFT M.B.H. & CO. KG., Wels (AT)

( * ) Notice: Subject to any disclaimer, the term of this patent is extended or adjusted under 35 U.S.C. 154(b) by 0 days.

(21) Appl. No.: 17/278,710

(22) PCT Filed: Sep. 24, 2019

(86) PCT No.: PCT/AT2019/060313
§ 371 (c)(1),
(2) Date: Mar. 23, 2021

(87) PCT Pub. No.: WO2020/061602
PCT Pub. Date: Apr. 2, 2020

(65) Prior Publication Data

US 2021/0309033 A1 Oct. 7, 2021

(30) Foreign Application Priority Data

Sep. 24, 2018 (AT) ..... A 50819/2018

(51) Int. Cl.
*B41K 1/12* (2006.01)
*B41K 1/40* (2006.01)

(52) U.S. Cl.
CPC . *B41K 1/40* (2013.01); *B41K 1/12* (2013.01)

(58) Field of Classification Search
CPC ... B41K 1/00; B41K 1/04; B41K 1/10; B41K 1/12; B41K 1/36; B41K 1/38; B41K 1/40
See application file for complete search history.

(56) References Cited

U.S. PATENT DOCUMENTS 3,099,955 A 8/1963 Keck
3,714,894 A 2/1973 Robinson
(Continued)

FOREIGN PATENT DOCUMENTS

AT 379 552 B 1/1986
AT 2996 U1 8/1999
(Continued)

OTHER PUBLICATIONS

International Search Report in PCT/AT2019/060313, dated Nov. 15, 2019.
(Continued)

*Primary Examiner* — Matthew G Marini
*Assistant Examiner* — Marissa Ferguson-Samreth
(74) *Attorney, Agent, or Firm* — Collard & Roe, P.C.

(57) ABSTRACT

Turning device for a self-inking stamp includes a housing and an actuating bracket. The housing has, on each of two opposite side walls, one control cam curved at least in sections for a turning shaft. The bracket is connected and displaceable relative to the housing. On each of two limbs arranged parallel to the housing side walls, the bracket has one turning shaft guide arranged transversely to a displacement direction of the bracket relative to the housing. The guide and the control cam overlap partially at least on a first side and in at least one position of the bracket relative to the housing and configure an opening which is continuous from an outer side, so that a turning shaft is introduceable in the longitudinal direction from the outside into the turning device. The guides have in each case one displaceably mounted sliding bush with a turning shaft bearing.

11 Claims, 9 Drawing Sheets

(56) References Cited

U.S. PATENT DOCUMENTS

| | | | | |
|---|---|---|---|---|
| 4,603,628 | A | 8/1986 | Just | |
| 6,453,813 | B1 | 9/2002 | Faber | |
| 7,520,221 | B2 | 4/2009 | Ameshofer | |
| 9,333,784 | B2 * | 5/2016 | Faber | B41K 1/10 |
| 10,654,302 | B2 | 5/2020 | Scharinger et al. | |
| 2009/0139060 | A1 | 6/2009 | Shih | |
| 2012/0017786 | A1 | 1/2012 | Shih | |

FOREIGN PATENT DOCUMENTS

| | | | | | |
|---|---|---|---|---|---|
| AT | 501286 | B1 | | 8/2006 | |
| AT | 517 322 | A1 | | 12/2016 | |
| CA | 1037313 | A | | 8/1978 | |
| CN | 201506087 | U | | 6/2010 | |
| CN | 103522777 | A | | 1/2014 | |
| CN | 203567385 | U | | 4/2014 | |
| CN | 203567386 | | * | 4/2014 | B41K 3/04 |
| CN | 104802545 | A | | 7/2015 | |
| CN | 204998164 | U | | 1/2016 | |
| CN | 107912031 | A | | 4/2018 | |
| DE | 1906426 | A1 | | 11/1969 | |

OTHER PUBLICATIONS

Austrian Office Action in A 50819/2018-1,2, dated Apr. 29, 2019, with English translation of relevant parts.
Chinese Office Action in CN 201980062537.1, dated Jul. 20, 2021.

* cited by examiner

TURNING DEVICE

CROSS REFERENCE TO RELATED APPLICATIONS

This application is the National Stage of PCT/AT2019/060313 filed on Sep. 24, 2019, which claims priority under 35 U.S.C. § 119 of Austrian Application No. A 50819/2018 filed on Sep. 24, 2018, the disclosure of which is incorporated by reference. The international application under PCT article 21(2) was not published in English.

BACKGROUND OF THE INVENTION

1. Field of the Invention

The invention relates to a turning device for a self-inking stamp and a method for the use thereof, the turning device comprising a housing and an actuating bracket, wherein the housing has, on each of two opposite side walls, a control cam which is curved at least in sections for a turning shaft, wherein the actuating bracket is connected to the housing and can be displaced relative to the housing, wherein on each of two limbs which are arranged parallel to the side walls of the housing, the actuating bracket has a guide for a turning shaft, wherein the guide is arranged transversely with respect to a displacement direction of the actuating bracket with respect to the housing, wherein the guide and the control cam overlap partially and form an opening which is continuous from an outer side at least on a first side and in at least one position of the actuating bracket relative to the housing, so that a turning shaft can be introduced in the longitudinal direction from outside into the turning device. The turning device has neither an impression tool nor an ink pad nor a turning shaft and is therefore per se not a complete stamp. The guides are used for the movable mounting of a turning shaft.

2. Description of the Related Art

Such turning devices have the advantage that they enable stamps to be individualized as late as possible: a generic turning device without impression tool (plate carrier or type element) can be manufactured in comparatively large quantities, delivered and stored; thus, all possibilities for individualization remain open and the individualization can be carried out close to the final customer and directly before acceptance or by the final customer himself who receives the impression tool separately and joins it together with the turning device. As a result, for example, a standardized turning device can be manufactured and held in stock independently of international differences (e.g. different date formats for type elements for Europe and North America).

Such a turning device is already known from AT 517322 A1. The impression tool and the turning shaft can be removed from the stamp shown there so that a turning device is formed. This has a comparatively complex structure since it aims to avoid a central strut and therefore spring elements are arranged laterally in both limbs of the actuating bracket. As a result of this arrangement, the housing is closed laterally in one embodiment and the shaft cannot be removed along its longitudinal direction; for removal the control cam (or cam track) is interrupted by an exchange channel along which the turning shaft is introduced or removed in the radial direction (i.e. transversely to the axis). This device makes it possible to use an impression tool with axle stubs formed in one piece. Disadvantages here are the complex structure and the necessary locking of the exchange channel in order to avoid the impression tool unintentionally falling out.

AT 517322 A1 discloses a further turning device. In this case, a shaft exchange opening for a continuous shaft for subsequent mounting of a text plate holder is provided on a bracket-shaped upper part or a lower part.

Furthermore, CA 1037313 A discloses a turning device wherein a shaft extends through control cams in a frame to an outer side of limbs. Also US 2012017786 A1 discloses a turning shaft running through a vertical guide of the limbs and a control cam of the housing. AT 379552 B discloses a stamp insert with a pivot axis which passes through control slots and also elongate holes. Also U.S. Pat. No. 3,099,955 A discloses a turning shaft of a printing unit which runs through control cams of the side parts of a base frame.

Further turning devices are described in CN 204998164 U, CN 201506087 U and U.S. Pat. No. 3,714,894 A.

BRIEF SUMMARY OF THE INVENTION

It is the object of the invention to propose a turning device which avoids the above disadvantages.

This object is solved according to the invention in a turning device of the type mentioned initially whereby the guides each have a displaceably mounted sliding bush with a bearing for the turning shaft.

As a result, an exchange channel and corresponding locks can be dispensed with. The housing additionally has a receptacle for an ink pad holder. The actuating bracket is held by a spring element in a stamp inking position and can be moved against the spring force of the spring element into an impression position. The control cam can, for example, be a control slot or however be formed by a groove closed on one side. The guides in the limbs can, for example, be executed as elongate holes. The displacement direction of the actuating bracket corresponds to the impression direction during operation, i.e. in order to produce an impression the actuating bracket is displaced in the impression direction with respect to the housing. The guide comprises, for example, a plain bearing for the turning shaft.

Accordingly, the above object is achieved by a method for producing a self-inking stamp using such a turning device, an impression tool and a turning shaft, the method comprising the steps: introducing the impression tool into the turning device from an underside; and introducing the turning shaft along the longitudinal direction of the turning shaft from a first side through the housing and the actuating bracket, through the impression tool and as far as a second side of the housing and the actuating bracket.

The guide or the control cam can have on a second side opposite the first side a stop for a turning shaft introduced in longitudinal direction. Such a stop can prevent any sliding-through of the turning shaft in the longitudinal direction and thus assists a defined and correct positioning of the turning shaft in the finished stamp.

Optionally at least one of the guides can have a connecting element for producing a snap-in connection with a turning shaft accommodated therein. The connecting element can, for example, be a snap-in hook or a snap-in strip which can engage in an annular groove in a turning shaft in order to secure this against any unintentional movement in the longitudinal direction. Such a fixing can be configured so that it forms a resistance which can be overcome with a sufficient force so that it is possible to intentionally remove the turning shaft and exchange an impression tool.

Furthermore, the actuating bracket can have a first delimiting element, wherein the housing has a corresponding second delimiting element, wherein the two delimiting elements are adapted for delimiting a displacement of the actuating bracket and block the actuating bracket against any separation from the housing. As a result of such measures, it can be achieved that the turning device during handling only on the housing or only on the actuating bracket even without an inserted shaft does not fall apart into its individual parts.

The guides each comprise a displaceably mounted sliding bush with a bearing for a turning shaft. In this case, the limbs of the actuating bracket can comprise plan bearings for the sliding bushes; for example, each sliding bush can be mounted displaceably in an elongate hole formed in the limb. The afore-mentioned optional connecting element can be part of at least one of the sliding bushes; for example, in the form of a resiliently radially deflectable latching element with a radially inwardly directed latching projection which can engage in a latching recess such as a circumferential-side annular groove in the turning shaft. The axial bearings formed by the sliding bushes can be rotary plain bearings.

In connection with the use of sliding bushes it can be provided that the guides are linear guides for a displaceably mounted sliding bush. That is, a movement of the sliding bush in the direction of a longitudinal axis of a turning shaft accommodated therein is blocked. For example, an edge strip of the linear guide can engage in a parallel groove in a sliding bush so that the sliding bush is guided linearly along the edge strip. As a result, the sliding bush is fixed in the direction parallel to the longitudinal direction of a turning shaft so that during insertion or withdrawal of a turning shaft the sliding bush remains in its position.

Furthermore, at least one of the sliding bushes can form the first delimiting element. In this case, the sliding bush forms a projection on the inner side or outer side of the limb which in the direction of a stamp inking position impinges upon a stop on or in the housing, e.g. the edge of a slot in the housing and blocks a further movement of the actuating bracket in the direction away from the housing.

Individualization of a stamp using the present turning device can be particularly simplified if the sliding bushes are connected to a tool frame for receiving an impression tool. The impression tool can, for example, be a text plate carrier with a text plate or a type element.

Accordingly the present disclosure provides an optional variant of the afore-mentioned method in which the impression tool is introduced into the tool frame.

In connection with a tool frame it can be provided that at least one of the sliding bushes is connected to the tool frame via a snap-in connection. The tool frame is then held in the housing by the sliding bushes and remains there even without a turning shaft. In detail, the sliding bush can have a pin, for example, which is snapped into a receptacle in the tool frame.

Finally, the present disclosure also relates to a self-inking stamp with a turning device according to one of the variants described above with an impression tool received therein and with a turning shaft running through the turning device and the impression tool.

It can be provided that the turning shaft is connected to the impression tool via a snap-in connection and is secured against any movement in the longitudinal direction of the turning shaft. For example, a latching projection in the impression tool can engage in an annular groove in a central part of the turning shaft wherein the central part designates that part of the turning shaft along which the impression tool extends.

BRIEF DESCRIPTION OF THE DRAWINGS

The invention will be explained in further detail hereinafter with reference to exemplary embodiments to which the invention should not however be limited and with reference to the drawings. The drawings show in detail.

DETAILED DESCRIPTION OF THE INVENTION

FIGS. 1 to 5 show a first embodiment of a turning device 1.

Figure 1:
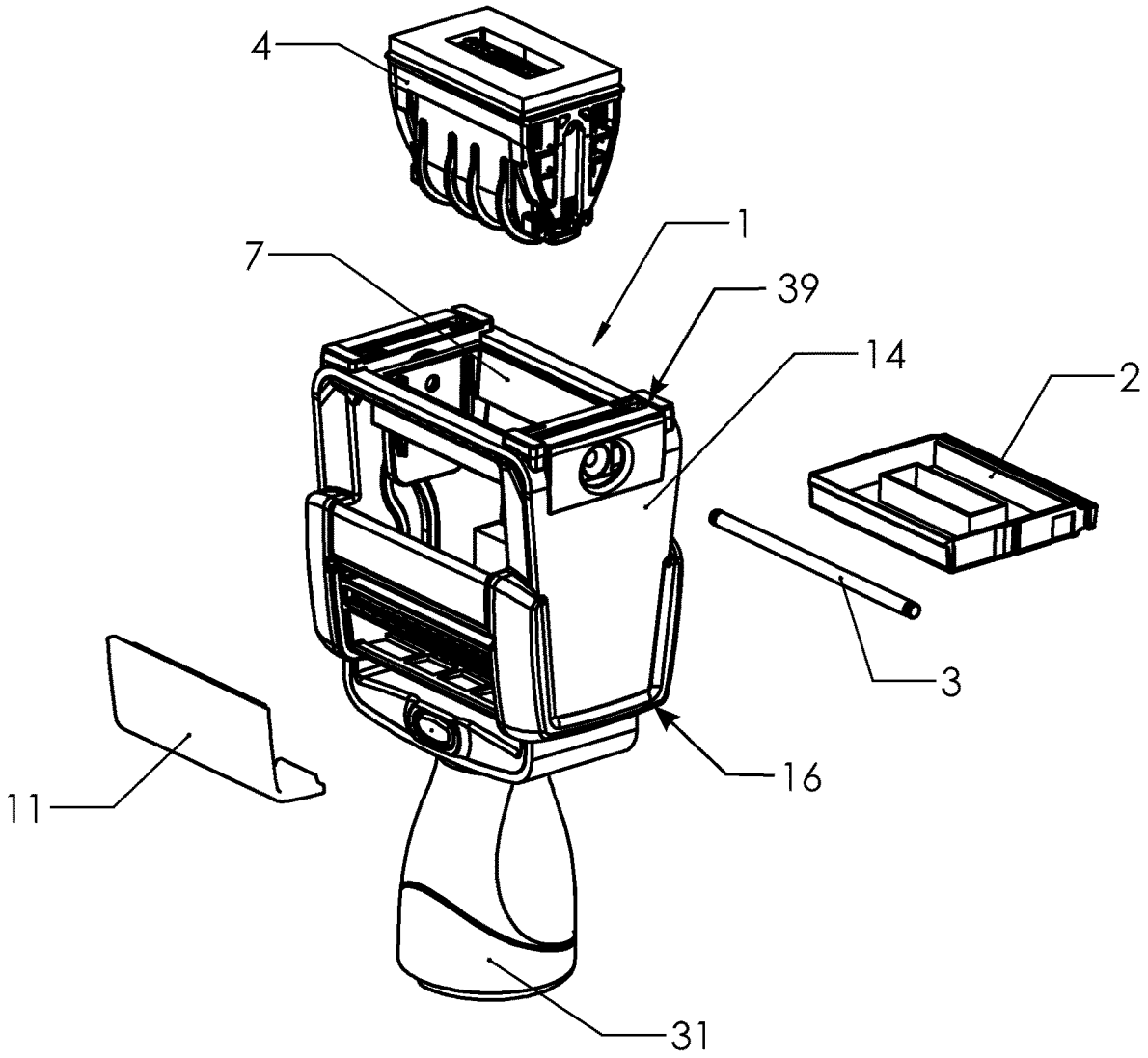
FIG. 1 shows a diagrammatic view of a turning device of the present type according to a first embodiment with a tool frame and with separately depicted individualizing components pad holder, turning shaft and type element.
Figure 2:
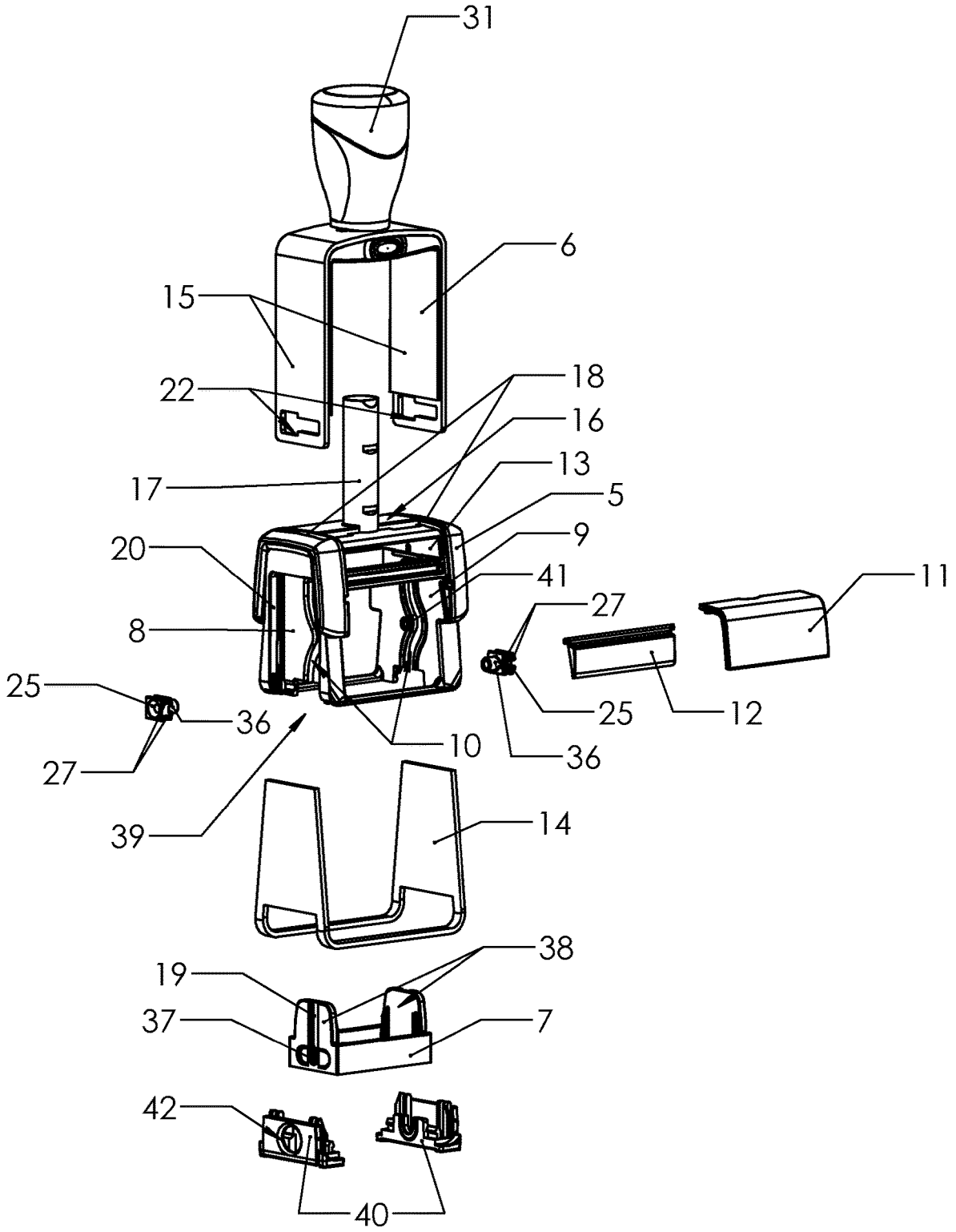
FIG. 2 shows an exploded drawing of the turning device according to FIG. 1.

In FIGS. 1 and 2 the turning device 1 is shown separately, i.e. as an incomplete self-inking stamp before an individualization. The components 2-4 which can be used for individualization and completion of the stamp are shown separately in FIG. 1: an ink pad holder 2 with an ink pad, a turning shaft 3 and an impression tool 4 in the form of a type element (alternatively a text plate carrier with a text plate).

As can be seen from FIG. 2 in particular, the turning device 1 comprises a housing 5, an actuating bracket 6 as well as a tool frame 7. The housing 5 has on two opposite side walls 8, 9 respectively one control cam 10 which is curved at least in sections for a turning shaft 3. The two control cams 10 are executed as curved slots in the side walls 8, 9. A cover 11 and a mirror 12 are connected to the housing 5, wherein the cover 11 covers an insertion compartment 13 for the ink pad holder 2 and the mirror 12. The cover 11 and the mirror 12 are snapped in pivotably on the housing. A frame plate 14 is pushed from below over the actual (inner) housing 5. The frame plate 14 covers most of the control cams 10 towards the outer side on both sides (cf. FIG. 5). As a result, a receiving space for the limbs 15 of the actuating bracket 6 is held free between the housing and the frame plate 14 on both sides and thus counteracts collisions or jamming of objects. On the upper side 16 of the housing 5 this has a perpendicular strut 17 and two through slots 18 for the limbs 15. In addition to the control cams 10, turning pins 41 are provided on the inner side of the side walls 8, 9 which are each guided in a corresponding receptacle 19 in the tool frame 7 and together with the control cams 10 bring about the turning of the tool frame 7 together with an impression tool 4 accommodated therein during the movement of the actuating bracket 6 between the impression position (cf. FIG. 3) and the stamp inking position (cf. FIG. 5). On an underside 39 of the housing 5 feet 40 are connected to the housing and fixed with snap-in connections. The feet 40 can serve as the termination of an (optionally) open control cam 10 and have anti-slip underlayers of rubber. The first foot 40 on a first side 29 has an opening 42 for the introduction and removal of the turning shaft 3 whereas the second foot 40 has no such opening.

Figure 3:
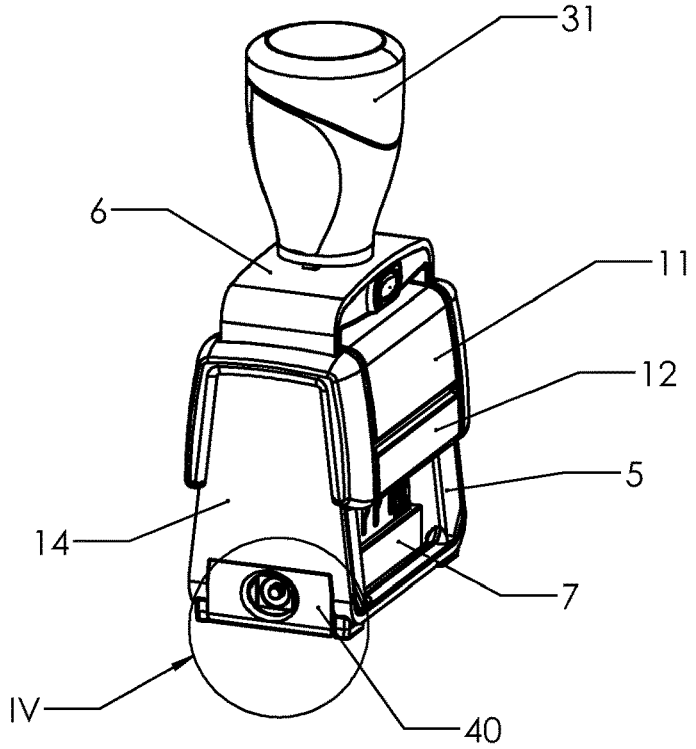
FIG. 3 shows a self-inking stamp with a turning device according to FIG. 1 after an individualization, wherein the type element and the turning shaft are inserted, in an impression position.
Figure 4:
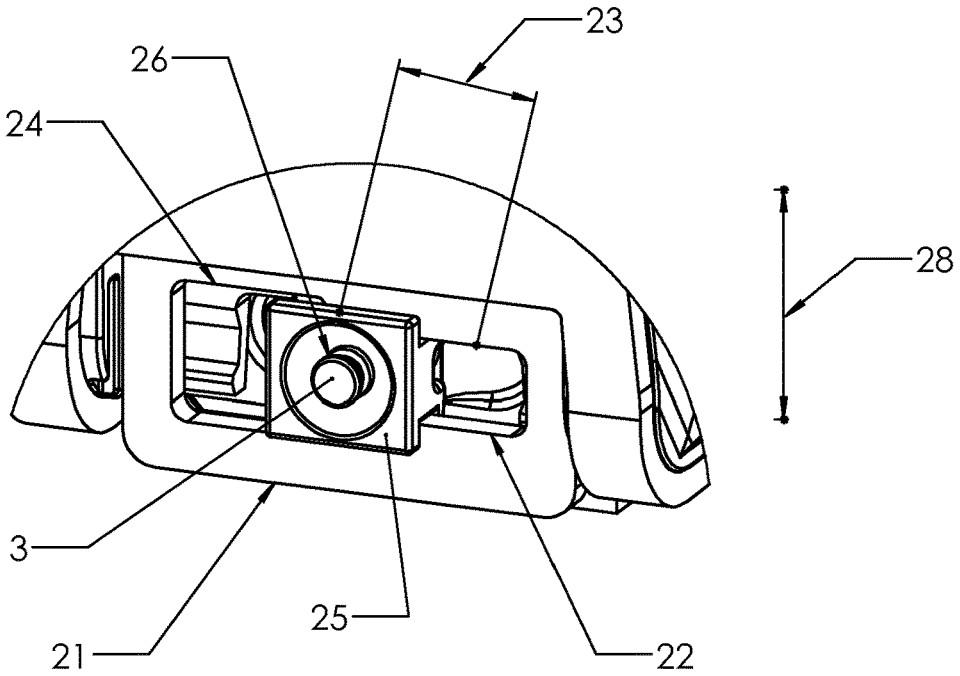
FIG. 4 shows an enlarged view of the detail IV from FIG. 3, but with the foot removed.
Figure 5:
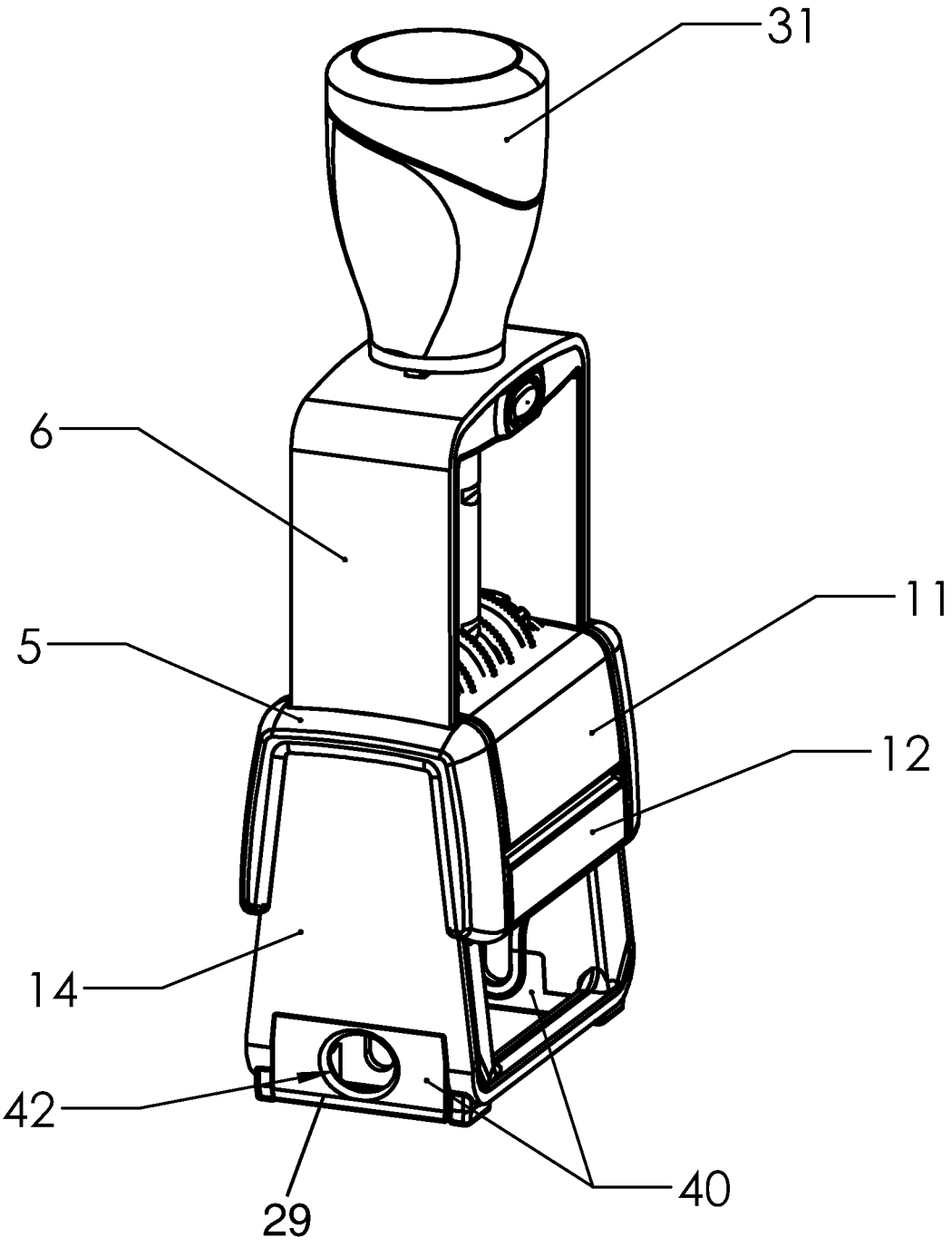
FIG. 5 shows the self-inking stamp according to FIG. 3 in a stamp inking position.
Figure 6:
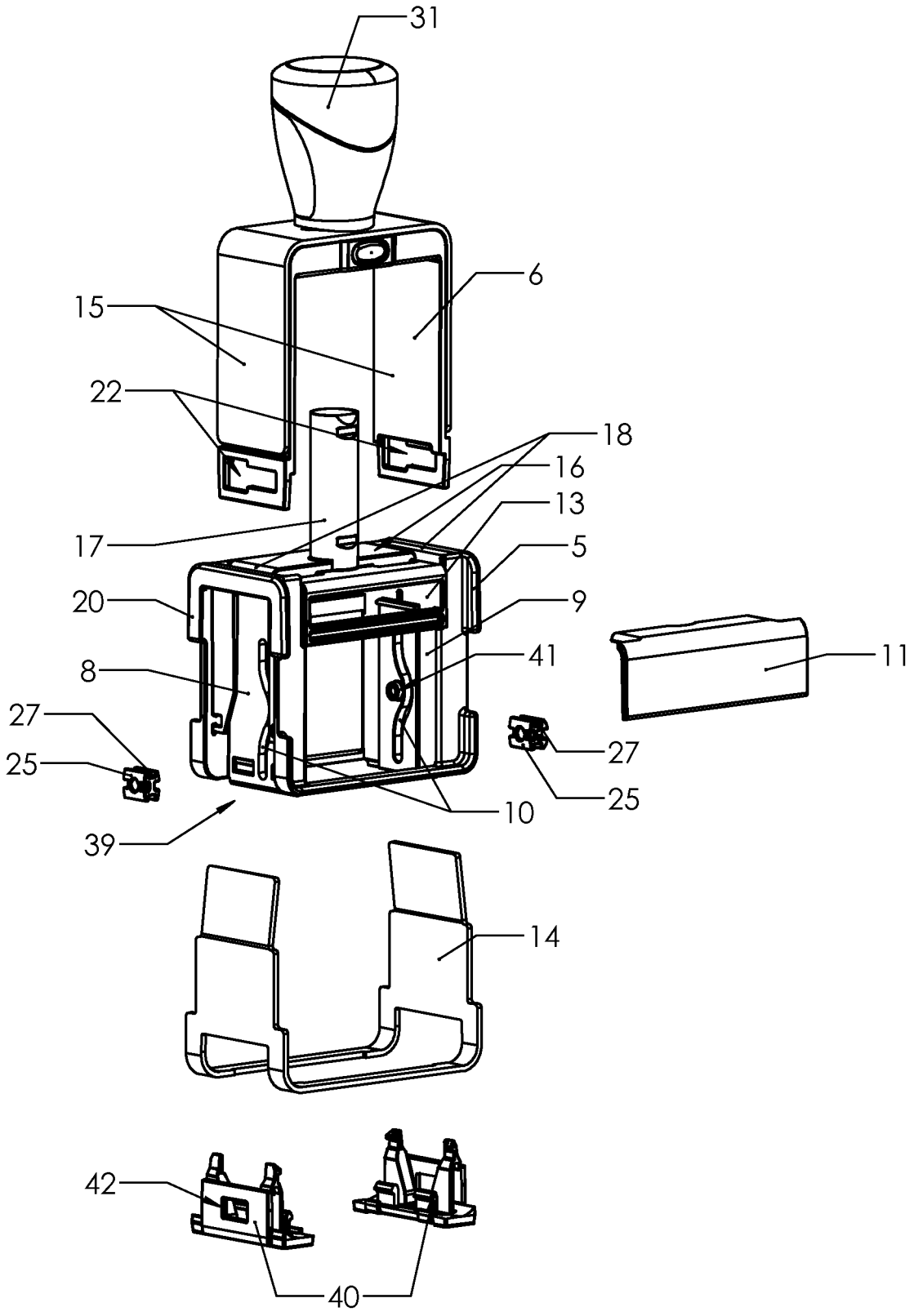
FIG. 6 shows an exploded drawing of an alternative embodiment of a turning device without tool frame.
Figure 7:
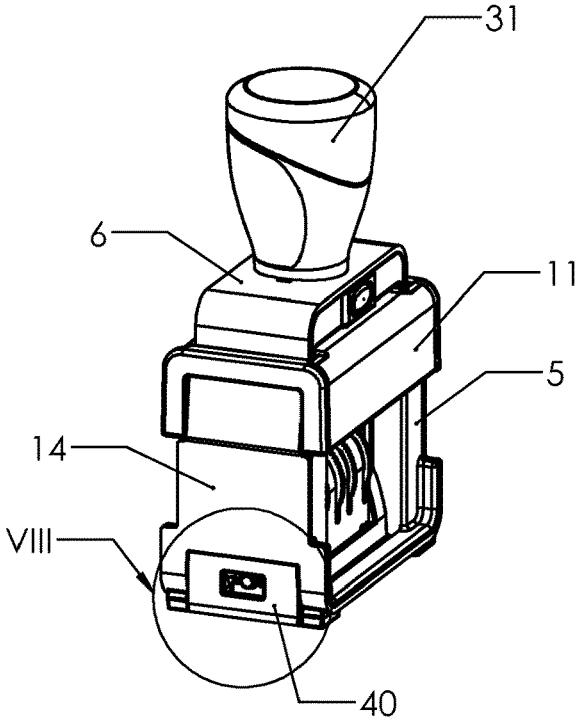
FIG. 7 shows a self-inking stamp with a turning device according to FIG. 6 after an individualization, wherein the type element and the turning shaft are inserted, in an impression position.
Figure 8:
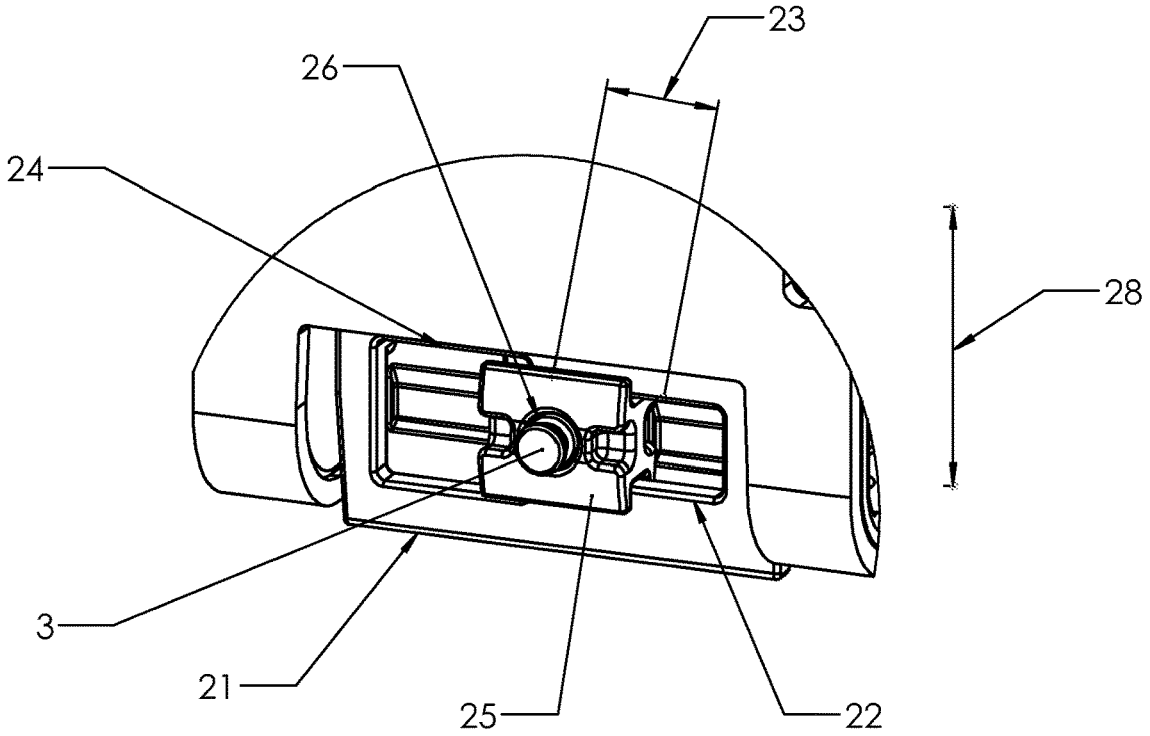
FIG. 8 shows an enlarged view of the detail VIII from FIG. 7 but with the foot removed.

The actuating bracket 6 is guided through the through slot 18 of the housing 5 and is displaceable relative to the housing (cf. FIGS. 3 and 5). In this case, the outer edges of the limbs 15 are each guided linearly along and between two parallel guide surfaces 20 in the housing 5 respectively. The actuating bracket 6 has one guide 21 for a turning shaft on each of the two limbs 15 arranged parallel to the side walls 8, 9 of the housing 5 (cf. FIG. 4) respectively. The two guides 21 each have an elongate hole 22 which has a constant width in a working area 23 and next to the working area 23 has a widened section 24 for introducing a sliding bush 25 during manufacture of the turning device 1. The working area 23 is that area within which the sliding bush 25 is displaced during operation of a stamp as a result of the course of the control cams 10. In both elongate holes 22 a sliding bush 25 is mounted slidingly displaceably in each case so that the elongate holes 22 are plain bearings for the sliding bushes 25. The sliding bushes 25 each have a central cylindrical passage 26 which serves as a rotary plain bearing for a turning shaft 3. On the outer side the sliding bushes 25 have a groove 27 at the top and bottom (in relation to a usage position of a stamp) in which the edges of the elongate hole 22 are received so that the elongate holes 22 in the working area 23 form linear guides for the sliding bushes 25. In the finished stamp the turning shaft 3 is mounted movably in the guide 21. The guide 21 is arranged substantially transversely to a direction of displacement 28 or impression direction of the actuating bracket 6 with respect to the housing 5. The guide 21 and the control cams 10 overlap on both sides.

In the impression position of the actuating bracket 6 relative to the housing 5, the guide 21 (elongate hole 22, sliding bush 25 and passage 26) and the control cam 10 form a continuous opening which is accessible from an outer side, on a first side 29 so that a turning shaft 3 can be introduced in longitudinal direction 30 from outside in the turning device 1 or can be removed therefrom again.

Figure 9:
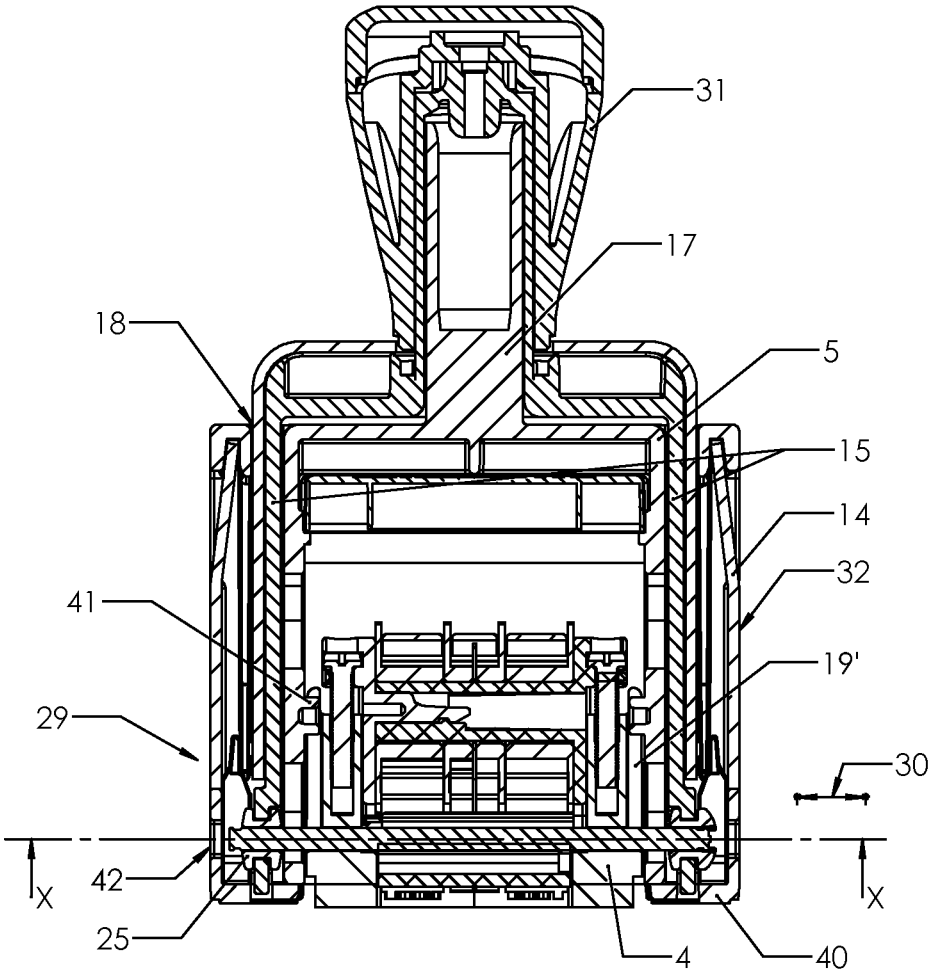
FIG. 9 shows a vertical section of the stamp according to FIG. 7.

The actuating bracket 6 is held by a spring element in the strut 17 (for the sake of simplicity, the spring element is not shown in FIG. 9) in a stamp inking position and can be moved against the spring force of the spring element into an impression position. In the impression position the strut 17 is received in a handle 31 on the upper side of the actuating bracket.

The two sliding bushes 25 form (first) delimiting elements in the form of widenings of the limbs 15 so that the widenings cannot overcome the slots 18 in the housing 5 (as second delimiting elements) through which the limbs 15 are guided into the housing 5.

In addition, the sliding bushes 25 hold a tool frame 7 for receiving an impression tool in the housing 5, whereby projections directed into the interior of the housing are snapped into receptacles 37 provided for this purpose in the tool frame 7 and are thus connected. During the manufacture of the turning device 1 the short side walls 38 of the tool frame 7 are temporarily pressed inwards.

In the assembled state of a self-inking stamp shown in FIGS. 3 to 5, an impression tool 4 in the form of a type element is received in the tool frame 7 and a turning shaft 3 runs through the turning device 1 (sliding bushes 25, control slots 10 and tool frame 7) and the impression tool 4.

The alternative embodiment shown in FIGS. 6 to 10 functions largely the same as the first embodiment described above. In order to avoid repetitions, functionally the same parts are therefore designated with the same reference numbers and reference is made in this respect to the above description.

The most distinct difference between the two embodiments is that the alternative embodiment has no tool frame 7. Accordingly the sliding bushes 25 are devoid of projections 36. The impression tool 4 is thus held directly by the turning shaft 3. The turning pins 41 are guided in corresponding receptacles 19' directly in the impression tool 4.

Figure 10:
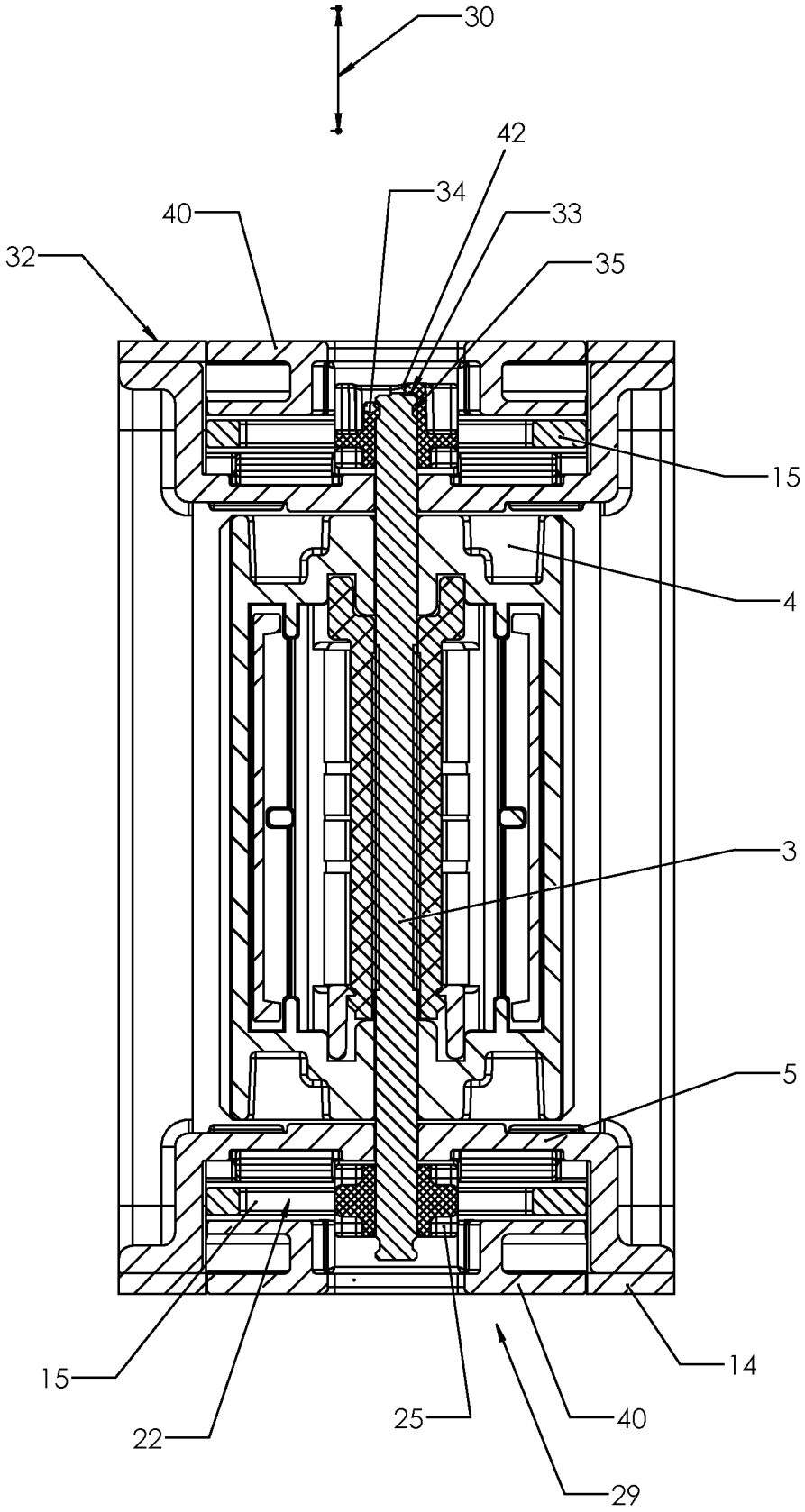
FIG. 10 shows a horizontal section of the stamp according to FIG. 7 along a line X-X in FIG. 9.

As can be seen from the sections in FIGS. 9 and 10, the first sliding bush 25 on a first side 29 is continuous for the turning shaft 3; the second sliding bush 25 on a second side 32 has a stop 33 for a turning shaft 3 introduced in longitudinal direction 30. In addition, the second sliding bush 25 has a connecting element 34 in the form of a snap-in hook for producing a snap-in connection with a turning shaft 3 accommodated therein, more precisely an annular groove 35 in the turning shaft 3.

Figure 11:
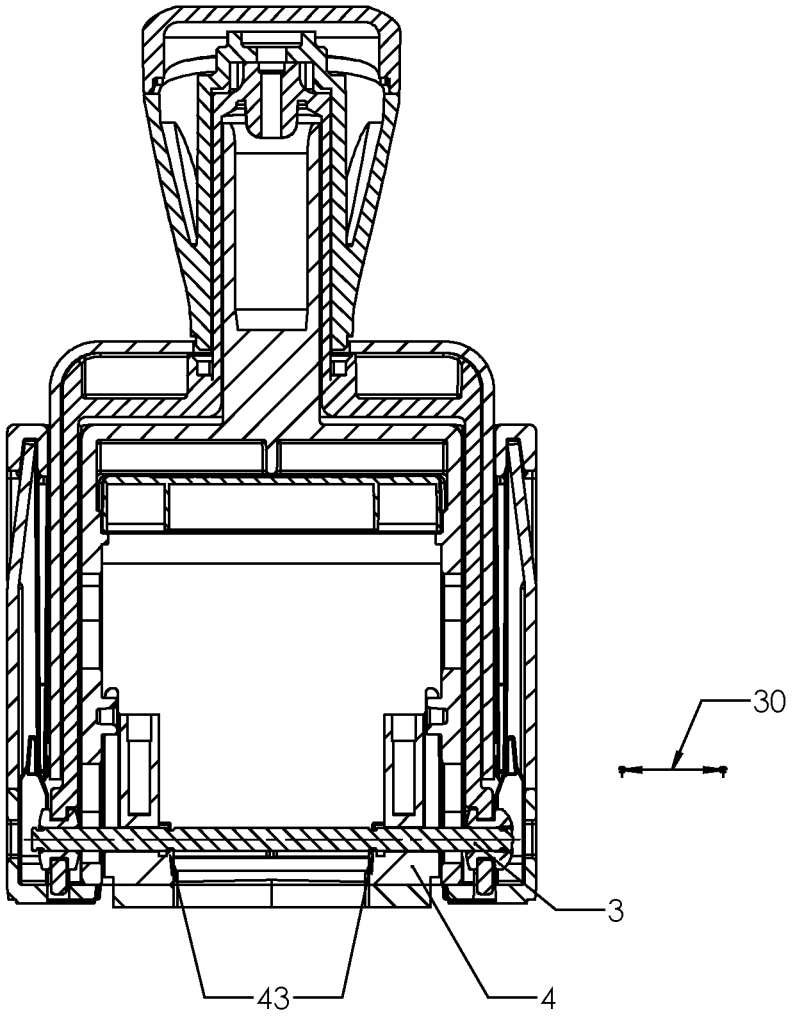
FIG. 11 shows a vertical section along a further alternative turning device.

The alternative embodiment shown in FIG. 11 functions largely the same as the last-described embodiment. Unlike that embodiment, the turning shaft 3 is connected via a snap-in connection 43 to the impression tool 4 and is thus secured against any movement in longitudinal direction 30 of the turning shaft 3. Unlike FIG. 9, the turning device 1 in FIG. 11 is shown without type element but with an impression tool 4 in the form of a text plate carrier with a recess for a type element.

The invention claimed is:

1. A turning device for a self-inking stamp, comprising:

a housing and an actuating bracket, wherein the housing has, on each of two opposite side walls, a control cam which is curved at least in sections for a turning shaft, wherein the actuating bracket is connected to the housing and can be displaced relative to the housing, wherein on each of two limbs which are arranged parallel to the side walls of the housing, the actuating bracket has a guide for a turning shaft, wherein at least one of the guides is arranged transversely with respect to a displacement direction of the actuating bracket with respect to the housing, wherein at least one of the guides and the control cam overlap partially and form an opening which is continuous from an outer side at least on a first side and in at least one position of the actuating bracket relative to the housing, so that a turning shaft can be introduced in the longitudinal direction from outside into the turning device, wherein the guides each have a displaceably mounted sliding bush with a bearing for a turning shaft, wherein the guides of the displaceably mounted sliding bushes are linear guides which each block a movement of the sliding bushes in a direction of a longitudinal axis of a turning shaft to be received therein, wherein an edge strip of at least one of the respective linear guide engages in a parallel groove in at least one of the respective sliding bushes.

2. The turning device according to claim 1, wherein at least one of the guides or the control cam have on a second side opposite the first side a stop for a turning shaft introduced in the longitudinal direction.

3. The turning device according to claim 1, wherein at least one of the guides has a connecting element for producing a snap-in connection with a turning shaft accommodated therein.

4. The turning device according to claim 1, wherein the actuating bracket has a first delimiting element, wherein the housing has a corresponding second delimiting element, wherein the two delimiting elements are adapted for delimiting a displacement of the actuating bracket and block the actuating bracket against any separation from the housing.

5. The turning device according to claim 4, wherein at least one of the displaceably mounted sliding bushes forms the first delimiting element.

6. The turning device according to claim 1, wherein the displaceably mounted sliding bushes are connected to a tool frame for receiving an impression tool.

7. The turning device according to claim 6, wherein at least one of the sliding bushes is connected to the tool frame via a snap-in connection.

8. A self-inking stamp with a turning device according to claim 1 with an impression tool received therein and with a turning shaft running through the turning device and the impression tool.

9. The self-inking stamp according to claim 8, wherein the turning shaft is connected to the impression tool via a snap-in connection and is secured against any movement in a longitudinal direction of the turning shaft.

10. A method for producing a self-inking stamp, the method comprising the steps of:

providing an impression tool and a turning shaft;

providing a turning device comprising:

a housing and an actuating bracket, wherein the housing has, on each of two opposite side walls, a control cam which is curved at least in sections for the turning shaft, wherein the actuating bracket is connected to the housing and can be displaced relative to the housing, wherein on each of two limbs which are arranged parallel to the side walls of the housing, the actuating bracket has a guide for the turning shaft, wherein at least one of the guides is arranged transversely with respect to a displacement direction of the actuating bracket with respect to the housing, wherein at least one of the guides and the control cam overlap partially and form an opening which is continuous from an outer side at least on a first side and in at least one position of the actuating bracket relative to the housing, so that a turning shaft can be introduced in the longitudinal direction from outside into the turning device, wherein the guides each have a displaceably mounted sliding bush with a bearing for a turning shaft, wherein the guides of the displaceably mounted sliding bushes are linear guides which each block a movement of the sliding bushes in a direction of a longitudinal axis of a turning shaft to be received therein, wherein an edge strip of at least one of the respective linear guide engages in a parallel groove in at least one of the respective sliding bushes, introducing the impression tool into the turning device from an underside; and introducing the turning shaft along the longitudinal direction of the turning shaft from a first side through the housing and the actuating bracket, through the impression tool and as far as a second side of the housing and the actuating bracket.

11. The method according to claim 10, further comprising the steps of:

connecting the displaceably mounted sliding bushes to a tool frame for receiving the impression tool; and introducing the impression tool into the tool frame.

* * * * *